US007681667B2

(12) United States Patent
Pia

(10) Patent No.: US 7,681,667 B2
(45) Date of Patent: Mar. 23, 2010

(54) DRILLING APPARATUS

(75) Inventor: Giancarlo Pia, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 108 days.

(21) Appl. No.: 11/567,089

(22) Filed: Dec. 5, 2006

(65) Prior Publication Data

US 2007/0144787 A1 Jun. 28, 2007

Related U.S. Application Data

(63) Continuation of application No. 10/296,956, filed as application No. PCT/GB01/03577 on Aug. 9, 2001.

(30) Foreign Application Priority Data

Aug. 11, 2000 (GB) ..... 0019854.9

(51) Int. Cl.
*E21B 10/32* (2006.01)

(52) U.S. Cl. ..... 175/286; 175/265; 175/383; 175/263

(58) Field of Classification Search ..... 175/265, 175/271, 269, 289, 290, 383, 284, 286, 384, 175/263
See application file for complete search history.

(56) References Cited

U.S. PATENT DOCUMENTS

| | | | | | |
|---|---|---|---|---|---|
| 112,063 | A | * | 2/1871 | Mills | 408/188 |
| 814,768 | A | | 3/1906 | Clarkson | |
| 1,022,129 | A | | 4/1912 | Evans et al. | |
| 1,494,274 | A | | 5/1924 | Morgan | |
| 2,049,450 | A | | 8/1936 | Johnson | |
| 2,060,352 | A | | 11/1936 | Stokes | |
| 2,216,895 | A | * | 10/1940 | Stokes | 175/269 |
| 2,324,679 | A | | 7/1943 | Cox | |
| 2,743,087 | A | | 4/1956 | Layne et al. | |
| 3,387,893 | A | | 6/1968 | Hoover | |
| 3,575,245 | A | | 4/1971 | Cordary et al. | |
| 4,031,972 | A | | 6/1977 | Burg | |
| 4,189,185 | A | | 2/1980 | Kammerer et al. | |
| 4,396,076 | A | * | 8/1983 | Inoue | 175/265 |
| 4,407,377 | A | | 10/1983 | Russell | |
| 4,491,187 | A | | 1/1985 | Russell | |

(Continued)

FOREIGN PATENT DOCUMENTS

| | | |
|---|---|---|
| GB | 540 027 | 10/1941 |

(Continued)

OTHER PUBLICATIONS

M. Gelfgat, "Retractable Bits Development and Application" Transactions of the ASME. vol. 120, Jun. 1998, pp. 124-130.

(Continued)

*Primary Examiner*—Daniel P Stephenson
(74) *Attorney, Agent, or Firm*—Patterson & Sheridan, LLP

(57) ABSTRACT

Drilling apparatus, such as an underreamer comprises a generally cylindrical tubular body and two cutting blades pivotally mounted to the body and movable between a retracted position and an extended position. Each cutting blade has a retracted position minimum gauge cutting portion and an extended position maximum gauge cutting portion, with the blades in the extended position the gauge cutting portions extending axially and being located in a transverse plane on or forward of the blade pivot axis.

32 Claims, 6 Drawing Sheets

U.S. PATENT DOCUMENTS

| | | | | |
|---|---|---|---|---|
| 4,604,818 | A | 8/1986 | Inoue | |
| 4,904,119 | A | 2/1990 | Legendre et al. | |
| 5,141,063 | A | 8/1992 | Quesenbury | |
| 5,201,817 | A | 4/1993 | Hailey | |
| 5,361,859 | A | 11/1994 | Tibbits | |
| 5,402,856 | A | 4/1995 | Warren et al. | |
| 5,853,054 | A | 12/1998 | McGarian et al. | |
| 6,076,618 | A | 6/2000 | Asberg | |
| 6,315,062 | B1 | 11/2001 | Alft et al. | |
| 6,427,788 | B1 | 8/2002 | Rauchenstein | |
| 6,607,046 | B1 | 8/2003 | Betts et al. | |
| 6,953,096 | B2 | 10/2005 | Glendhill et al. | |
| 7,100,713 | B2 | 9/2006 | Tulloch | |
| 2003/0111267 | A1* | 6/2003 | Pia | 175/57 |
| 2003/0141111 | A1 | 7/2003 | Pia | |
| 2003/0183424 | A1 | 10/2003 | Tulloch | |
| 2004/0124011 | A1 | 7/2004 | Glendhill et al. | |

FOREIGN PATENT DOCUMENTS

| | | |
|---|---|---|
| GB | 0643197 | 9/1950 |
| GB | 838 833 | 6/1960 |
| GB | 2172315 | 9/1986 |
| GB | 2211221 | 6/1989 |
| GB | 2 320 270 | 6/1998 |
| WO | WO 0181708 | 11/2001 |

OTHER PUBLICATIONS

Dean E. Gaddy, Editor, "Russia Shares Technical Know-How with U.S." Oil & Gas Journal, Mar. 1999, pp. 51-52 and 54-56.

* cited by examiner

DRILLING APPARATUS

CROSS-REFERENCE TO RELATED APPLICATIONS

This application is a continuation of co-pending U.S. patent application Ser. No. 10/296,956, filed on Nov. 26, 2002, which is a § 371 application of PCT Application No. PCT/GB01/03577, filed on Aug. 9, 2001, which claims benefit of GB 0019854.9, filed on Aug. 11, 2000. Each of the aforementioned related patent applications is herein incorporated by reference.

BACKGROUND OF THE INVENTION

1. Field of the Invention

This invention relates to drilling apparatus and in particular to expandable drilling or reaming apparatus.

2. Description of the Related Art

GB-A-2 320 270 describes an underreamer with extendable cutting blades. The tool may be run into a bore on a tubular drill string with the blades in a retracted position that is with the cutting face of each blade extending longitudinally of the tool body. On reaching the cutting location, an increase in fluid pressure within the body induces movement of a piston which acts, via appropriate cam faces, to pivot the blades through 90° to an extended cutting position.

In the retracted position, the blades lie adjacent and overlapping one another, within the circumference of the body. While this provides for a compact "running" arrangement, it limits the available cutting area of the blades and also prevents the blades from cutting while in the retracted position. Further, to permit full extension of the blades it is necessary for parts of the blade cutting faces to pass through a position just prior to the fully extended position, where the effective diameter described by the blades is larger than the bore gauge cut by the blades in the fully extended position. Thus, the blades must cut a profile in the bore wall to permit full extension. Similarly, on retraction of the blades following reaming of a section of bore, it is necessary for the blades to cut an enlarged diameter profile in the bore to permit blade retraction, or to pull the tool back up to the previously cut profile, before the blades may retract. Clearly, the requirement to cut such a profile is time-consuming and inconvenient, and is also impractical when the underreamer is located, for example, within steel casing.

Due to the 90° rotation of the blades from the retracted position to the extended position, a portion of the cam face on each blade is rotated to a position where the cam face forms a part of the cutting face of the blade, and thus is exposed to an increased risk of wear and damage, which could interfere with the subsequent successful retraction and extension of the blades.

It is among the objectives of embodiments of the present invention to obviate or mitigate these and other disadvantages of this and other prior art arrangements.

SUMMARY OF THE INVENTION

According to a first aspect of the present invention, there is provided drilling apparatus comprising:

a body; and at least two cutting blades pivotally mounted to the body and movable between a retracted position and an extended position, the cutting blades each having a maximum gauge cutting portion, in the extended position the gauge cutting portions being located in a transverse plane on or forward of the blade pivot axis.

As the maximum gauge cutting portions always lie on or forward of the blade pivot axis, the blades may move between the extended and retracted positions without having to pass through a position where the blades define a diameter larger than the extended blade cutting gauge.

Preferably, the blades are located at or towards the end of the body, such that there is no limit placed on the blade length.

Preferably, the blades are rotatable through an angle of less than 90° and most preferably are rotatable through an angle of about 45°.

Preferably, cutting portions of each blade extend across the full width of the blade in a direction parallel to the pivot axis or axes of the blades. This allows provision of a relatively large cutting surface, providing enhanced stability and allowing for cutting element redundancy. Most preferably, the maximum gauge cutting portions comprise part-cylindrical cutting areas.

Preferably, the blades are adapted to cut in both the retracted and extended positions. Thus, in the retracted position, the blades define a swept cutting area of larger diameter than the body; drill cuttings may thus pass between the body and the bore wall, avoiding any tendency for the cuttings to jam the apparatus in the bore. Preferably also, each cutting blade has a retracted position gauge cutting portion. Most preferably, with the blades in the retracted position, these cutting portions define part-cylindrical cutting areas. With the blades in the extended position, these cutting portions may provide cutting areas useful for back-reaming. The retracted position gauge cutting portions also facilitate extension of the blades by allowing the cutting of an increasing diameter bore to accommodate blade extension.

Preferably, the cutting blades each define a cutting portion which, with the blades fully extended, defines a forward facing cutting face. In a preferred embodiment, the cutting faces extend over at least one half or more of the diameter swept by the blades. Most preferably, in the fully extended configuration, these cutting faces lie in a substantially transverse plane. With the blades fully extended, each gauge cutting portion preferably presents a cutting area in an axial plane. Thus, each forward facing cutting portion will lie substantially perpendicular to the respective gauge cutting portion, and preferably the transition between the two portions is provided with cutting elements, most preferably chisel tooth inserts. Preferably also, with the blades in the retracted positions, these cutting portion transitions define the leading edges of the blades. These leading edges are preferably in the form of lines or points and are adapted to minimize the lateral forces experienced by the blades such that the blades are not urged to expand, and the blade faces may further be adapted to urge the blades to remain in the retracted position. In other embodiments, the gauge hole may be cut by cutting elements provided on both the forward facing cutting portion and the maximum gauge cutting portions.

Preferably, the body has a leading end defining a cutting area, and which may carry cutting elements. Preferably, the cutting area is only exposed when the blades are extended. The cutting area may be utilized when the blades are extended and serve to cut a central area of the bore, the extended blades cutting an annular outer area, and thus the apparatus may be utilized to cut a relatively large diameter bore.

Preferably, the blades are pivotable on a common axis, which may be defined by a common pivot pin, but the blades may alternatively be pivotable on different axes. Most preferably, each blade engages the pivot pin at two locations, spaced along the length of the pin, thus stabilizing the blades, and minimizing pin and blade wear and loading.

Preferably, in the fully extended position, blade faces are provided to engage the body, the faces acting as stops and serving to transfer forces to the body, thus reducing the stress experienced by the pivot pins. Most preferably, the faces are formed to allow transfer of both axial and rotational forces.

Preferably, the apparatus includes a blade actuation arrangement. Preferably, the actuation arrangement positively engages each blade, thereby allowing for positive extension and retraction of the blades, and facilitating positive retention of the blades in a desired position, for example allowing application of weight on bit (WOB) in both extended, retracted, and intermediate positions. In a preferred embodiment, each blade defines a cam slot or groove and the actuation arrangement includes a cam follower, which may be in the form of a stud or pin. This allows elimination of blade return torsion springs between the blade and the pivot pin; a blade retraction arrangement may be provided at a more convenient location, for example within the body.

Preferably, the actuation arrangement is fluid pressure responsive, and in a preferred embodiment comprises one or more fluid pressure responsive pistons. Most preferably, the piston is biased towards a blade retracting position. The movement of the piston may be controlled or limited, for example the piston may be coupled to the body via a cam arrangement. This facilitates positive positioning of the blades in intermediate positions, or permits the apparatus to experience elevated fluid pressure or weight on bit (WOB) without lateral movement of the blades, for example the actuation arrangement may be held in a retracted position, with the blades in the retracted position, while fluid is circulated through the apparatus to supply ports or jets and the retracted blades are used for drilling. Such a piston may be bearing mounted to the body to facilitate relative rotation. The piston may act on the blades via an axially extending elongate member or rod, preferably via a pair of rods, which may be biased to a retracted position; where the blade actuation arrangement positively engages the blades, the blades are thus biased to the retracted position. The rods provide a convenient means of transferring force through the body. The actuation arrangement may comprise an axially movable skirt or sleeve. The skirt may define a piston area which is exposed to internal body fluid pressure, such that an increase in such pressure will tend, initially at least, to extend the skirt, and thus extend the blades.

Most preferably, the actuating piston is annular and defines a throughbore to permit fluid passage therethrough, which fluid may supply jetting nozzles or the like, or act on one or more further actuating pistons.

Preferably, the body defines one or more fluid passages which direct fluid onto or towards the blades. In one embodiment the blades also define fluid passages or channels which co-operate with body passages to carry fluid towards cutting portions or areas of the blades. The body may include at least one body passage which is only opened when the blades are extended. The resulting pressure drop may serve as an indicator to the operator that the blades have extended. The body may include at least one body passage which directs fluid to an area of the apparatus for cleaning or purging purposes, such that movement of the blades, particularly retraction, is not prevented by, for example, build-up of drill cuttings or other debris between parts of the apparatus.

The cutting portions or areas of the blades and body may be provided with any appropriate cutting elements or surfaces, including tungsten inserts and PDC cutters.

BRIEF DESCRIPTION OF THE DRAWINGS

This and other aspects of the present invention will now be described, by way of example, with reference to the accompanying drawings, in which.

DETAILED DESCRIPTION

Figure 1:
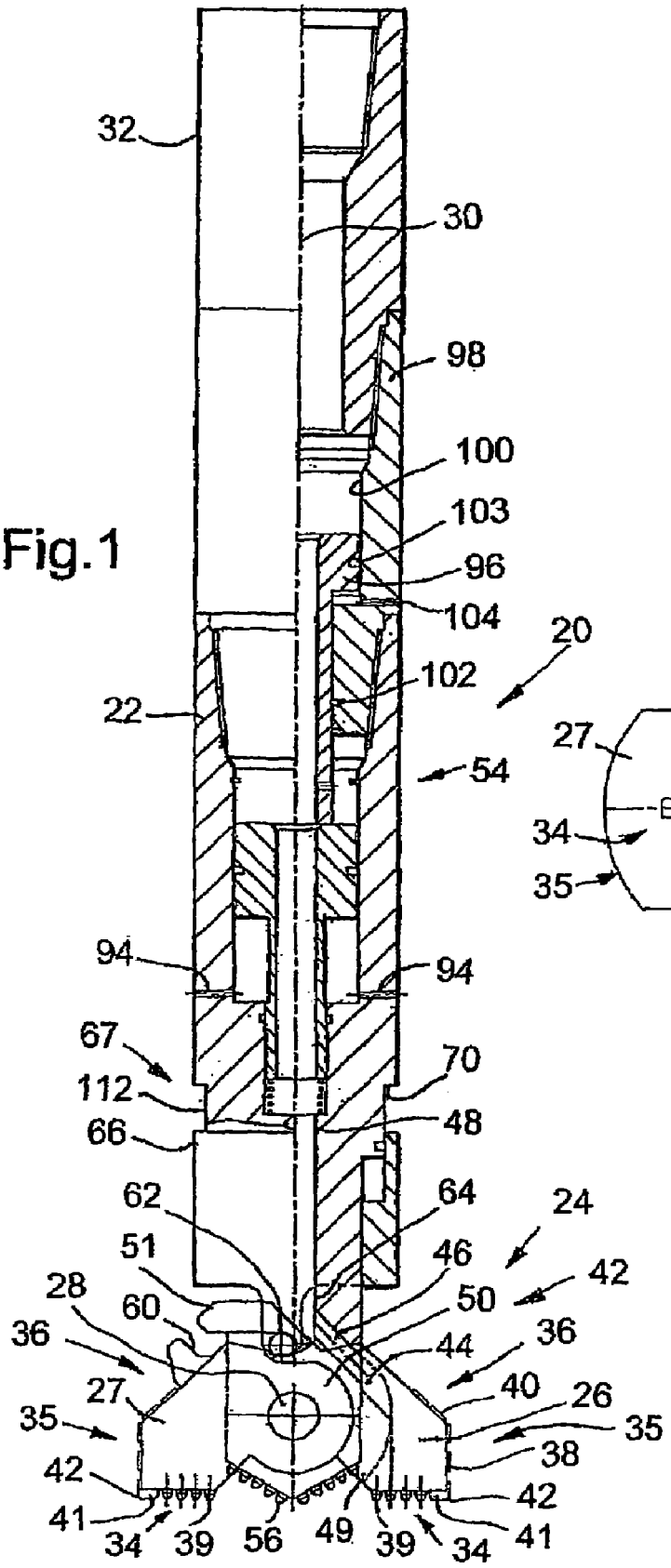
FIG. 1 is a part-sectional view of drilling apparatus in accordance with a first aspect of the present invention, shown with the blades of the apparatus in an extended position.

Reference is first made to FIGS. 1, 2, 3, and 4 of the drawings, which illustrate drilling apparatus 20 in accordance with a first embodiment of the present invention.

The apparatus 20 comprises a generally cylindrical tubular body 22 with a rectangular cross-section leading end body portion 24 providing mounting for two cutting blades 26, 27 via a pivot pin 28 which intersects and lies perpendicular to the body axis 30. The body 22 is adapted to be coupled to a saver sub 32 mounted on the leading end of a tubular drill string (not shown).

Figure 2:
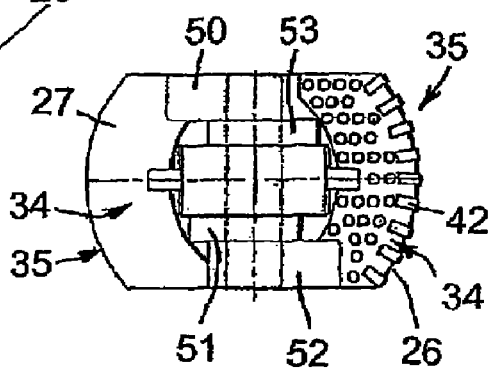
FIG. 2 is an end view of the apparatus of FIG. 1, shown with some cutting elements omitted.

The blades 26, 27 are pivotable between a retracted position (FIG. 3) and an extended position (FIGS. 1 and 2). Each blade 26, 27 defines three cutting faces 34, 35, 36, each providing mounting for respective cutting elements 38, 39, 40, such as tungsten carbide inserts. The first cutting faces lie perpendicular to the body axis 30 when the blades 26, 27 are extended, and each face 34 defines a relatively large area part-annular cutting face (see FIG. 2), providing for cutting element redundancy. The second cutting faces 35 lie perpendicular to the first faces 34 and are part-cylindrical. In the fully extended position, the faces 35 cut the bore gauge. The corner 41 between the faces 34, 35 is provided with cutting elements in the form of chisel tooth inserts 42. The third cutting faces 36 lie at 45° to the second faces 35 and in the fully extended position provide a cutting face useful for back-reaming.

Each blade 26, 27 defines a passage 44 which, when the blades 26, 27 are fully extended, communicates with a respective outlet 46 of a passage 48 in the body 22. In use, drilling fluid passes through the passages 48, 44 and exits the passage 44 at openings 49 adjacent the first cutting faces 34.

The blades 26, 27 are each mounted on the pivot pin 28 via a pair of spaced arms or lugs 50, 51 and 52, 53 and, as noted above, are pivotable between extended and retracted positions. The blades 26, 27 are fluid actuated under the control of an actuation arrangement 54, as will be described.

Figure 3:
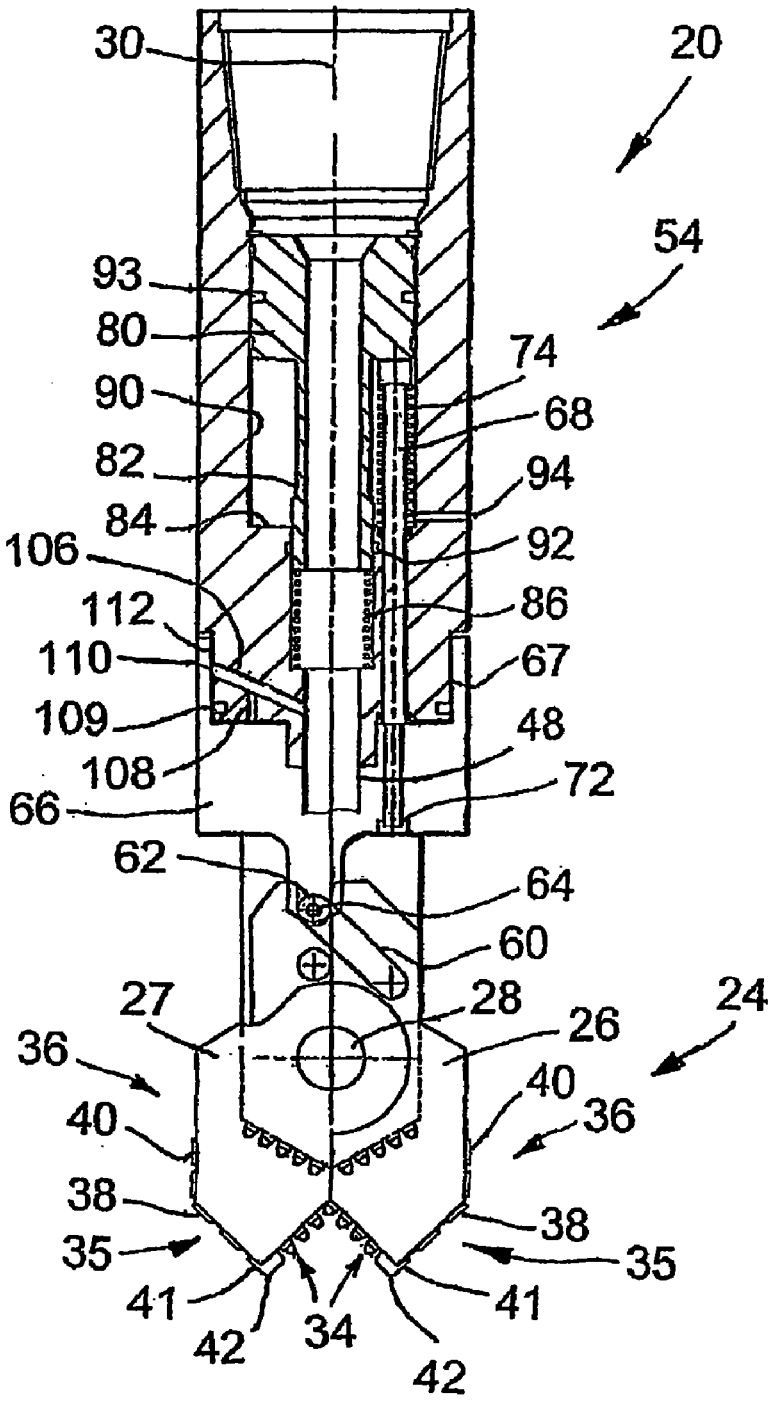
FIG. 3 is a part-sectional view of the drilling apparatus of FIG. 1, shown with the blades in a retracted position.
Figure 4:
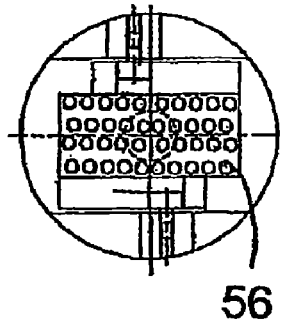
FIG. 4 is an end view of the apparatus of FIG. 1, shown with the blades omitted.

In the retracted position, as shown in FIG. 3, the blade corners 41 form the leading ends of the apparatus, and the arrangement is such that, while drilling in this configuration, the blades 26, 27 experience minimal lateral forces which would otherwise tend to extend the blades 26, 27. It will also be noted that, in this configuration, the third cutting faces 36 will cut the bore gauge.

With the blades 26, 27 in the extended configuration the apparatus 20 may be utilized for reaming an existing bore to a larger diameter, or for cutting a large diameter bore. As the extended blades 26, 27 define an annular swept area, the body portion 24 has a chisel end carrying cutting elements 56 which will cut the central bore area.

The blades 26, 27 each define a cam slot 60 which co-operates with a respective cam follower 62 mounted on a respective lug 64 extending from the end of a blade actuating skirt or sleeve 66 mounted on a stepped portion of the body 67. The skirt 66 is coupled to a pair of axially extending rods 68 (only one shown) which pass into the interior of the body 22, each rod 68 being fixed to the skirt 66 by means of an opposing shoulder 70 and a circlip 72. A compression spring 74 is mounted around each rod 68 between a further rod shoulder 76 and a face of the body. The springs 74 tend to retract the rods 68 into the body 22, and thus also tend to retract the skirt 66 and blades 26, 27.

The heads of the rods 68 are engaged by the head of an annular first actuating piston 80 mounted in the body 22, the piston 80 also having a hollow cylindrical extension 82 accommodated by a shouldered body bore portion 84. A compression spring 86 is provided between the bore shoulder 88 and the free end of the piston extension 82 and urges the piston 80 towards a blade retracted position. The head of the piston is movable in a chamber 90 isolated from the body bore by piston seals 92, 93 and the portion of the chamber 90 between the seals 92, 93 is in fluid communication with the body exterior via body ports 94.

The head of the piston 80 is engaged by the leading end of a second annular actuating piston 96 accommodated in an intensifier sub 98 forming part of the body 22. In a similar manner to the first piston 80, the head of the second piston 96 is movable in a chamber 100 isolated from the body bore by piston seals 102, 103, with the portion of the chamber 100 between the seals 102, 103 being in fluid communication with the body exterior via body ports 104. Both pistons 80, 96 are of one piece construction.

Due to the provision of the annular pistons 80, 96, drilling fluid may pass through the body 22 to the passages 48, 44, and also to passages 106 which direct fluid behind the skirt 66. Each passage 106 has an outlet 108 directing fluid into an area between seals 109 (only one shown) between the skirt and body, such that drilling fluid pressure will tend to move the skirt 66 towards the blade extended position. A further outlet 110 directs fluid into an annular cavity 112 formed between the body and the extended skirt 66, keeping the cavity 112 clear of drill cuttings and thus facilitating retraction of the skirt 66. The outlet 110 is also directed uphole, to facilitate circulation and cuttings entrainment away from the blades 26, 27.

In use, the apparatus 20 may be run into a drilled bore oh the end of a drill string, with the blades 26, 27 in the retracted position. If necessary the string may be rotated to assist in dislodging obstructions in the bore, or to remove any "skin" which may have formed on the wall of the bore. On reaching the end of the bore, the apparatus may be utilized to drill with the blades 26, 27 in a retracted position. However, the primary application of the apparatus 20 is drilling with the blades 26, 27 in the extended position. This is achieved by pumping drilling fluid through the string from surface, the resulting differential pressure between the body bore and the annulus between the body and the bore wall urging the pistons 80, 96 to extend the blades 26, 27 through 45°, in the illustrated example from an initial diameter of 311 mm to an extended diameter of 406 mm. Extension of the blades 26, 27 may be detected at surface by the drilling fluid pressure drop which occurs with the opening of the outlet 110, on extension of the skirt 66.

In the fully extend position, faces machined onto the blade locating arms 50, 53 engage the body extension. The faces serve as stops for the blades 26, 27. Further, the faces allow for transfer of forces directly to the body 22, thus reducing the stress experienced by the pivot pin 28, particularly when the apparatus is subject to weight-on-bit (WOB).

The blade cutting faces 34, 35, 36, and in particular the second and third faces 35, 36, are formed such that the blades 26, 27 may cut as they are extended, the relatively large area of the faces 35, 36 providing a large cutting area and subsequently a large number of active cutting elements.

Retraction of the blades 26, 27 is achieved simply by reducing the drilling fluid pressure, the various springs and the cam arrangement serving to positively retract the blades 26, 27 in the absence of the differential fluid pressure acting on the pistons 80, 96.

Further, the presence of wiper seals of the rods and skirt, and the purging of the skirt cavity, minimize the likelihood of any jamming or sticking during retraction.

Figure 5:
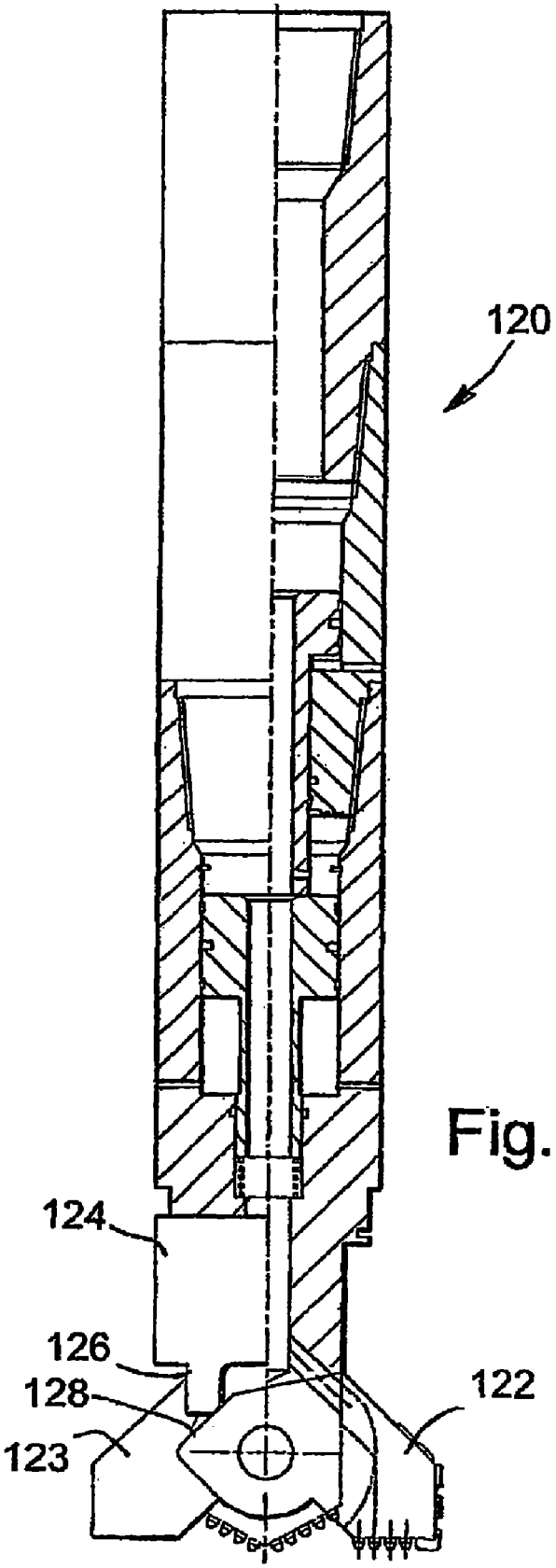
FIG. 5 is a part-sectional view of drilling apparatus in accordance with a second aspect of the present invention, shown with the blades of the apparatus in an extended position.
Figure 6:
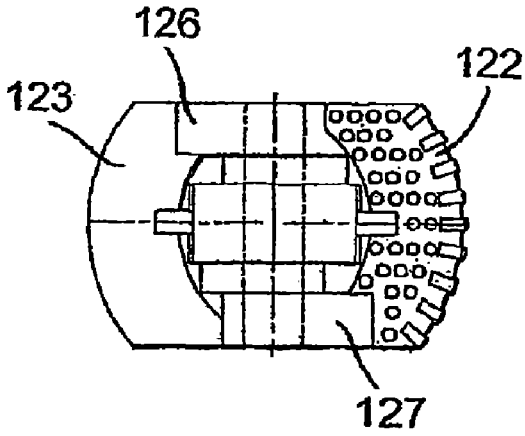
FIG. 6 is an end view of the apparatus of FIG. 5, shown with some cutting elements omitted.
Figure 7:
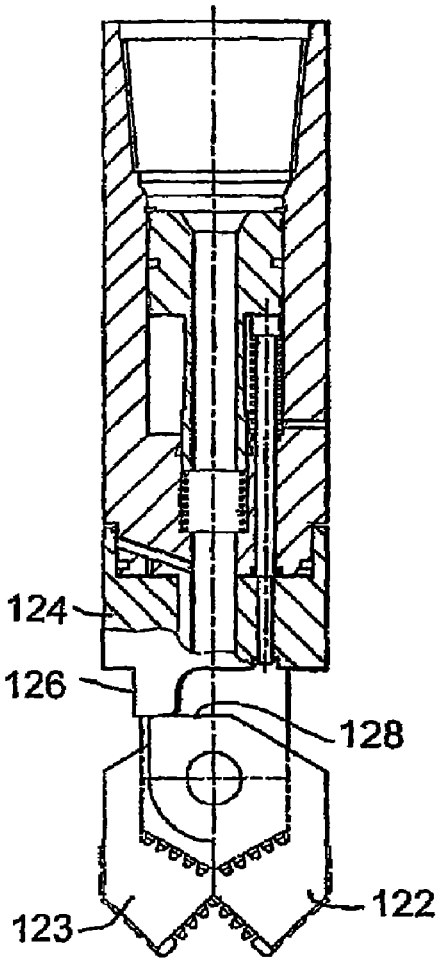
FIG. 7 is a part-sectional view of the drilling apparatus of FIG. 5, shown with the blades in a retracted position.

Reference is now made to FIGS. 5, 6, and 7 of the drawings, which illustrate drilling apparatus 120 in accordance with a further embodiment of the invention. The apparatus 120 shares many features with the apparatus 20 described above, and in the interest of brevity the common features will not be described again.

The primary difference between the two embodiments lies in the coupling between the blades 122, 123 and the actuating skirt 124: the blades 122, 123 are not positively engaged by the skirt 124, rather the skirt 124 includes a pair of lugs 126, 127 which abut cam faces 128 on the respective blade lugs. Due to the requirement of the blades to pivot through only 45°, the faces 128 do not form part of the cutting structure, and thus are unlikely to suffer erosion, and only a relatively short stroke is required to fully extend the blades, allowing the apparatus length to be kept down.

Reference is now made to FIGS. 8 to 12 of the drawings, which illustrate drilling apparatus 140 in accordance with a third embodiment of the invention. The apparatus 140 bears many similarities to the apparatus 20 described above, and the common features of the two embodiments will not be described again in any detail.

The primary difference lies in the form of the single actuating piston 142 which, in this embodiment, defines a cam track 144 which co-operates with a cam pin 146 mounted on the body 148. The piston 142 is mounted on an axial sleeve 150 fixed to the body 148, and is biased towards a retracted position by a compression spring 152 positioned around the sleeve 150. The piston 142 is coupled to the spring 152 via a bearing 154, facilitating rotation of the piston 142 as the pin 146 travels along the track 144.

Figure 9:
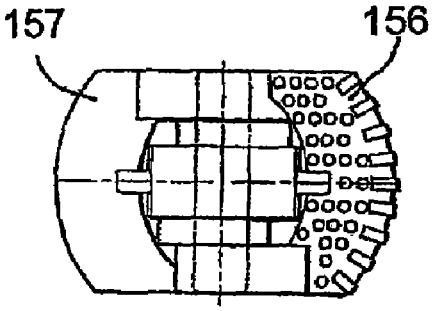
FIG. 9 is an end view of the apparatus of FIG. 8, shown with some cutting elements omitted.
Figure 8:
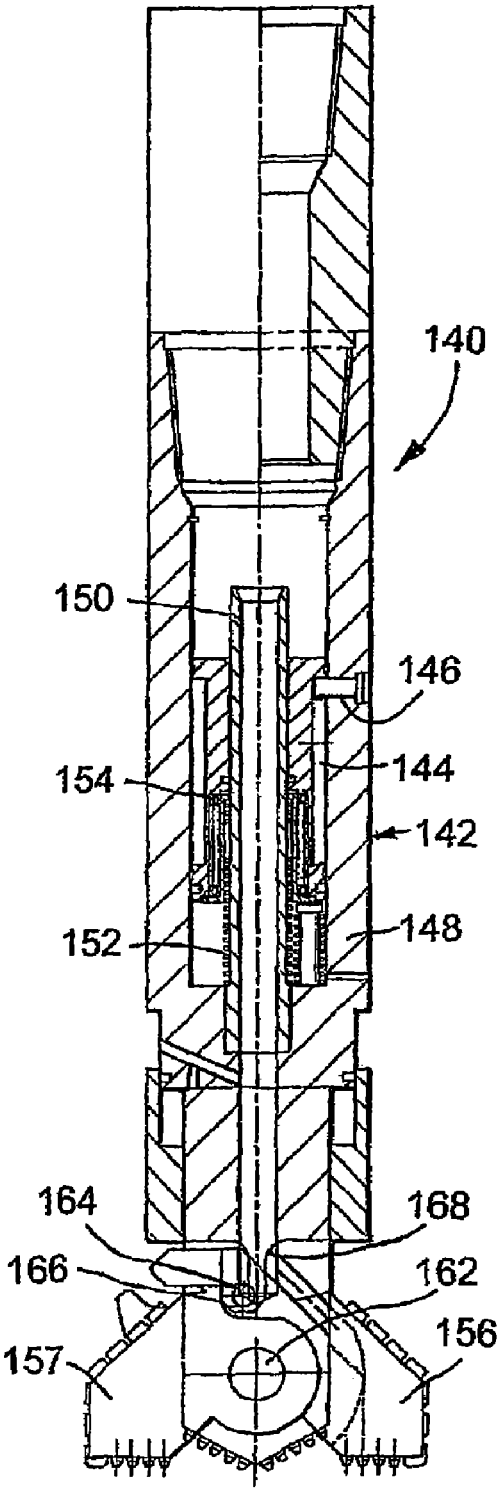
FIG. 8 is a part-sectional view of drilling apparatus in accordance with a third aspect of the present invention, shown with the blades of the apparatus in an extended position.
Figure 10:
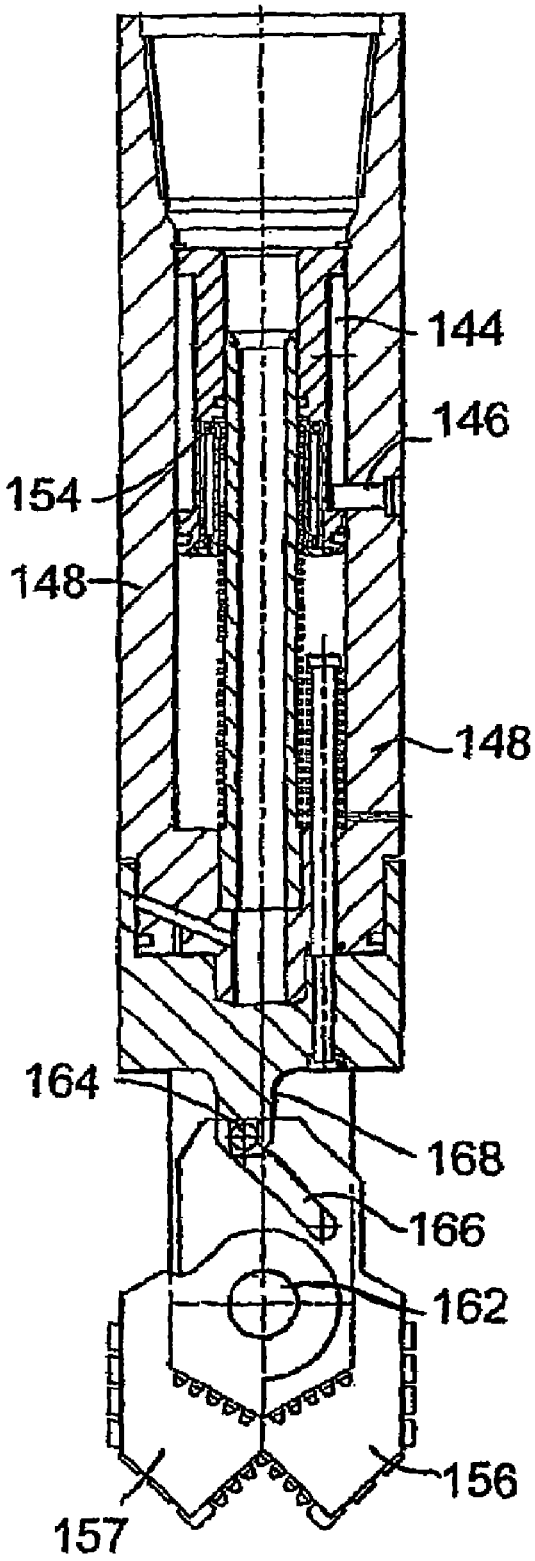
FIG. 10 is a part-sectional view of the drilling apparatus of FIG. 8, shown with the blades in a retracted position.
Figure 11:
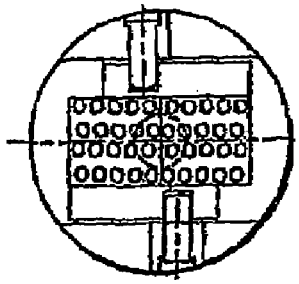
FIG. 11 is an end view of the apparatus of FIG. 8, shown with the blades omitted.
Figure 12:
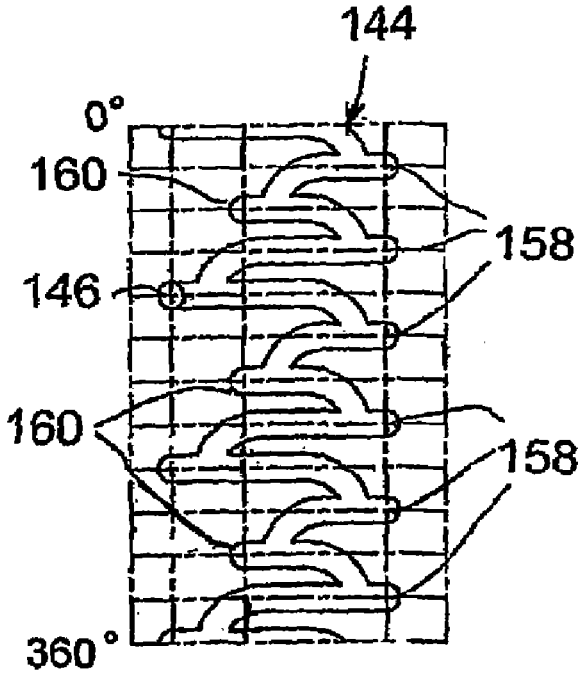
FIG. 12 is a view illustrating the cam profile defined by the actuating piston of the apparatus of FIG. 8.

FIG. 12 illustrates the position of the pin 146 in the track 144 when the blades 156, 157 are fully extended, as shown in FIGS. 8 and 9, in response to the circulation of drilling fluid through the apparatus. In the absence of circulation the blades 156, 157 retract to the position shown in FIG. 10, and the pin occupies one of the opposite cam end stops 158.

However, the cam track 144 also defines intermediate stops 160, which allow the blades 156, 157 to be retained in the retracted position in the presence of circulation or WOB. Thus, this apparatus 140 is suited to the drilling of pilot holes, with the blades 156, 157 held in the retracted position.

In the absence of circulation, the various springs ensure that the blades 156, 157 are or remain retracted.

In the light of greater likelihood of the blade pivot pin 162 experiencing WOB, the pin 162 is strengthened. Also, with the blades 156, 157 retracted, the blade cam pins 164 are located in axial portions of the blade cam slots 166, such that the pins 164 do not experience any axial forces, but do serve to prevent lateral movement of the blades 156, 157. Furthermore, the blade cam pins 164 are "captured" such that the pins 164 are retained and cannot fall out of the skirt lugs 168 in the event that the pins 164 are sheared.

In other embodiments of the invention, a cam profile may be provided which defines intermediate stops, that is stops which correspond to blade positions between the fully retracted and fully extended positions. This allows drilling or reaming of bores to one of a plurality of available diameters, which may be selected simply by controlled circulation of drilling fluid. To facilitate identification of blade configuration from surface, the body may include drilling fluid ports which-are opened as the blade actuating skirt advances, the drop in back pressure which occurs as each fluid port opens allowing the skirt position, and thus the blade configuration, to be determined from surface. Alternatively, the body may include an axially extending port which is progressively opened as the skirt advances.

Figure 13:
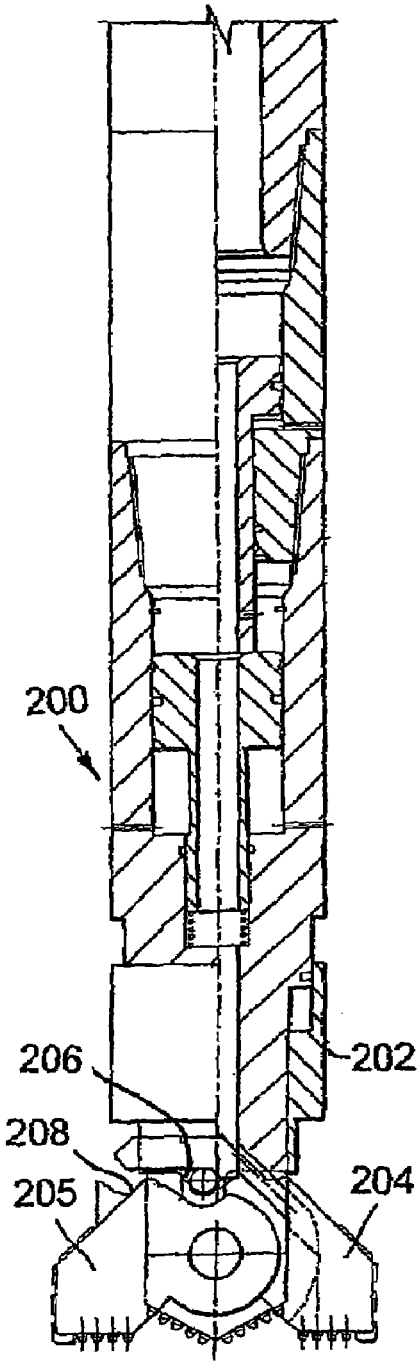
FIG. 13 is a part-sectional view of drilling apparatus in accordance with a fourth aspect of the present invention, shown with the blades of the apparatus in an extended position.
Figure 14:
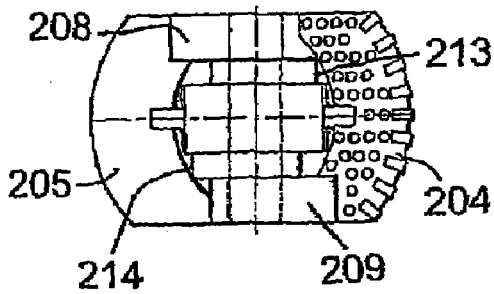
FIG. 14 is a view from below of the apparatus of FIG. 13.
Figure 15:
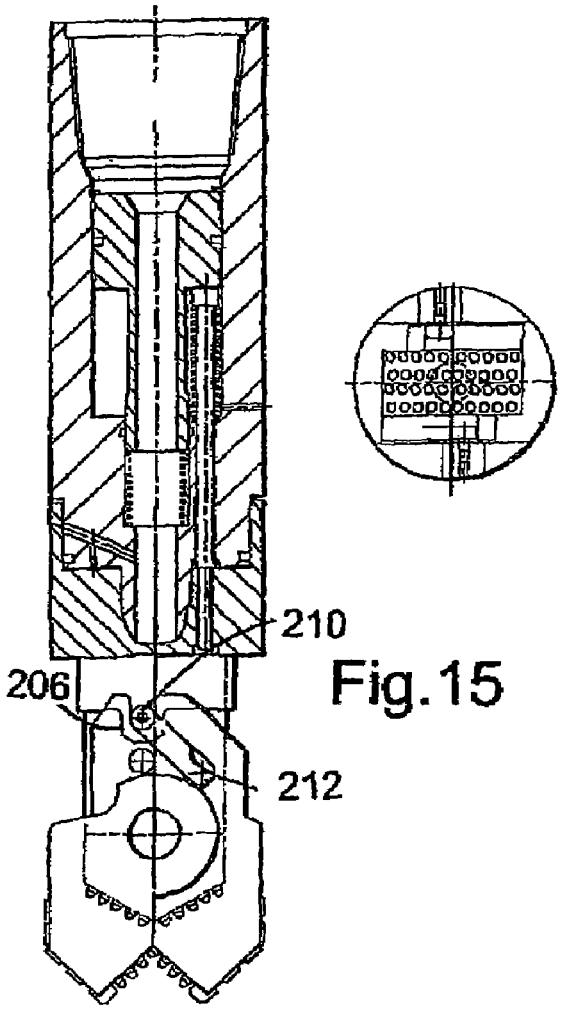
FIG. 15 is a part-sectional view of the drilling apparatus of FIG. 13, shown with the blades in a retracted position.

Reference is now made to FIGS. 13, 14 and 15 of the drawings which illustrate drilling apparatus, in the form of an underreamer 200 in accordance with a fourth aspect of the present invention. The underreamer 200 shares many features with the apparatus 20 as described above with reference to FIGS. 1 to 4, and in the interest of brevity the common features will not be described again in any detail. The primary difference between the two embodiments lies in the interaction between the actuating skirt 202 and the underreamer blades 204, 205. In particular, the skirt and blades are configured to provide a positive lock to retain the blades in the extended configuration, to facilitate back-reaming, as will be described below.

The skirt 202 is provided with profiled or castellated lugs 206 which, when the skirt is fully extended, as shown in FIG. 13, engage corresponding profiled faces on the outer lugs 208, 209 of the blades 204, 205. The cam followers 210 provided on the skirt 202 engage cam tracks 212 provided on the inner blade lugs 213, 214. To allow the blades 204, 205 to rotate from the extended configuration, the end of the cam tracks 212 are configured to permit an initial degree of retraction of the skirt 202 without inducing any rotation of the blades 204, 205. Thus, once the blades 204, 205 begin to rotate towards the retracted configuration, there is sufficient clearance between the skirt lugs 206 and the blade lugs 208, 209 to avoid any interference therebetween.

As noted above, this feature facilitates back-reaming, in which, for example, the underreamer 200 may be mounted on coiled tubing to which tension is being applied. The forces acting on the blades will tend to close the blades 204, 205; however, this tendency is resisted by the engagement of the lugs.

A similar effect may be achieved by other skirt and blade configurations, for example the skirt may define laterally extending end faces adapted to abut corresponding opposing faces of the inner blade lugs.

Those of skill in the art will appreciate that these various embodiments of the present invention provide drilling apparatus which overcomes many of the disadvantages of prior proposals. It will also be understood that various modifications and improvements may be made to these embodiments, without departing from the scope of the invention.

The invention claimed is:

1. A drilling apparatus comprising:

a body;

a blade actuation arrangement; and at least one cutting blade pivotally mounted to the body and movable between a retracted position and an extended position as a cam pin interacts with a cam track, wherein the at least one blade is capable of moving to one or more preset positions between the extended position and the retracted position, wherein the at least one blade is retainable in the one or more preset positions using one or more stops along the cam track, and the drilling apparatus is capable of simultaneously cutting inwardly of an outer diameter of the body and outwardly of the outer diameter of the body in each position.

2. The apparatus of claim 1, wherein the blade actuation arrangement positively engages the at least one blade.

3. The apparatus of claim 2, wherein the at least one blade defines a cam slot or groove and the blade actuation arrangement includes a cam follower.

4. The apparatus of claim 1, wherein a cutting surface of the body is fully exposed when the at least one cutting blade is in the extended position.

5. The apparatus of claim 1, wherein a portion of the body defines the cam track.

6. The apparatus of claim 1, wherein the at least one cutting blade is retainable in the retracted position in the presence of fluid circulation through the apparatus.

7. A method of forming a wellbore, the method comprising:

forming a hole with a drilling apparatus having at least one cutting blade in a retracted position;

moving the at least one cutting blade of the drilling apparatus to an extended position by moving a cam pin along a cam track in the drilling apparatus; and enlarging the hole with the drilling apparatus.

8. The method of claim 7, further including moving the at least one cutting blade to an intermediate position between the retracted position and the extended position.

9. The method of claim 8, further comprising forming a second hole with the at least one cutting blade in the intermediate position.

10. The method of claim 7, wherein the cam pin and the cam track are defined in a body of the drilling apparatus.

11. A drilling apparatus comprising:

a body having a cam pin; and at least one cutting blade pivotally mounted to the body and movable between a retracted position, an intermediate position and an extended position as the cam pin interacts with a cam track, wherein the cam pin and the cam track are positioned in the drilling apparatus at a location remote from the at least one cutting blade, wherein the drilling apparatus is capable of simultaneously cutting inwardly of an outer diameter of the body and outwardly of the outer diameter of the body in each position, wherein the at least one cutting blade is movable to the intermediate position and the extended position in response to circulation of drilling fluid through the drilling apparatus.

12. A drilling apparatus comprising:

a body;

a blade actuation arrangement having a piston that defines a cam track; and at least one cutting blade pivotally mounted to the body and movable between a retracted position and an extended position, wherein the at least one blade is capable of moving to one or more preset positions between the extended position and the retracted position and the drilling apparatus is capable of simultaneously cutting inwardly of an outer diameter of the body and outwardly of the outer diameter of the body in each position.

13. The apparatus of claim 12, further comprising a cam pin mounted on the body, wherein the cam pin is configured to interact with the cam track.

14. The apparatus of claim 13, wherein the piston is configured to rotate as the cam pin travels along the cam track.

15. The apparatus of claim 13, wherein the cam track defines at least one stop position corresponding to the extended position.

16. The apparatus of claim 13, wherein the cam track defines at least one stop position corresponding to the retracted position.

17. The apparatus of claim 16, wherein the cutting blade is biased in the retracted position such that the cam pin is positioned in the at least one stop corresponding to the retracted position.

18. The apparatus of claim 13, wherein the cam track defines at least one stop position corresponding to the preset position.

19. The apparatus of claim 18, wherein the cam track defines a second stop position corresponding to a second preset position.

20. A method of forming a wellbore, the method comprising:

forming a hole with a drilling apparatus having at least one cutting blade in a retracted position, wherein the drilling apparatus includes a blade actuation arrangement comprising a piston that defines a cam track that interacts with a cam pin mounted on a body of the drilling apparatus;

moving the at least one cutting blade of the drilling apparatus to an extended position; and enlarging the hole with the drilling apparatus.

21. The method of claim 20, further comprising circulating drilling fluid through the drilling apparatus to cause the piston to rotate as the cam pin travels along the cam track, thereby moving the at least one cutting blade between the retracted position and the extended position.

22. The method of claim 20, wherein the at least one cutting blade is moved between the retracted position to the extended position within the hole.

23. The method of claim 20, further comprising determining the position of the at least one cutting blade by monitoring a fluid back pressure generated by the drilling apparatus.

24. A drilling apparatus comprising:

a body having a cam pin and at least one drilling fluid port; and at least one cutting blade pivotally mounted to the body using a pivot in and movable between a retracted position and an extended position as the cam pin interacts with a cam track, wherein the at least one drilling fluid port opens as the at least one cutting blade moves between the retracted position and the extended position, and wherein the position of the at least one cutting blade is determined from surface by monitoring a fluid back pressure generated by the drilling apparatus.

25. The apparatus of claim 24, wherein the cam pin and the cam track are positioned in the drilling apparatus at a location remote from the at least one cutting blade.

26. The apparatus of claim 24, wherein the at least one blade defines a cam groove and a blade actuation arrangement includes a cam follower.

27. The apparatus of claim 26, wherein the cam pin and the cam track are located in the body.

28. A drilling apparatus comprising:

a body; and at least one cutting blade pivotally mounted to the body and movable to one or more preset positions between a retracted position and an extended position, wherein the at least one blade is retainable in the one or more preset positions using one or more stops along a cam track, wherein the drilling apparatus is capable of simultaneously cutting inwardly of an outer diameter of the body and outwardly of the outer diameter of the body in each position, wherein the position of the at least one cutting blade is determined from surface by monitoring a fluid back pressure generated by the drilling apparatus.

29. A drilling apparatus comprising:

a body;

a blade actuation arrangement; and at least one cutting blade pivotally mounted to the body and movable between a retracted position and an extended position as a cam pin interacts with a cam track, wherein a portion of the body defines the cam track, wherein the at least one blade is capable of moving to one or more preset positions between the extended position and the retracted position and the drilling apparatus is capable of simultaneously cutting inwardly of an outer diameter of the body and outwardly of the outer diameter of the body in each position.

30. The apparatus of claim 29, wherein the blade actuation arrangement positively engages the at least one blade.

31. The apparatus of claim 30, wherein the at least one blade defines a cam slot or groove and the blade actuation arrangement includes a cam follower.

32. The apparatus of claim 29, wherein a cutting surface of the body is fully exposed when the at least one cutting blade is in the extended position.

* * * * *

UNITED STATES PATENT AND TRADEMARK OFFICE

CERTIFICATE OF CORRECTION

PATENT NO. : 7,681,667 B2
APPLICATION NO. : 11/567089
DATED : March 23, 2010
INVENTOR(S) : Pia It is certified that error appears in the above-identified patent and that said Letters Patent is hereby corrected as shown below:

Title Page; In the Related U.S. Application Data (63):

Please delete Continuation of application No. 10/296,956, "filed as application No. PCT/GB01/03577 on Aug. 9, 2001." and insert Continuation of application No. 10/296,956, --which is a 371 application of PCT Application No. PCT/GB01/03577, filed on Aug. 9, 2001.-- therefor;

In the Claims:

Column 10, Claim 24, Line 8, please delete "in" and insert --pin-- therefor.

Signed and Sealed this

Fifteenth Day of June, 2010

David J. Kappos

David J. Kappos
*Director of the United States Patent and Trademark Office*